US006380855B1

(12) United States Patent
Ott

(10) Patent No.: US 6,380,855 B1
(45) Date of Patent: Apr. 30, 2002

(54) APPARATUS FOR SAFEGUARDING A MERCHANDISE ITEM AGAINST THEFT

(76) Inventor: Reinhold Ott, 6 Willow Street, Unit 2303, Waterloo, Ontario (CA), N2J 4S3

( * ) Notice: Subject to any disclaimer, the term of this patent is extended or adjusted under 35 U.S.C. 154(b) by 0 days.

(21) Appl. No.: 09/689,148

(22) Filed: Oct. 12, 2000

(30) Foreign Application Priority Data

Oct. 22, 1999 (DE) ..... 195 51 019
Oct. 22, 1999 (DE) ..... 199 51 020

(51) Int. Cl.[7] ..... G08B 13/12

(52) U.S. Cl. ..... 340/568.2; 340/568.1; 340/568.4; 340/568.8

(58) Field of Search ..... 340/568.1, 568.2, 340/568.4, 568.8, 572, 691, 693

(56) References Cited

U.S. PATENT DOCUMENTS 4,772,878 A * 9/1988 Kane ..... 340/568
5,066,942 A * 11/1991 Matsuo ..... 340/568
5,515,580 A * 5/1996 McHenry, Jr. ..... 24/16 PB
5,552,771 A * 9/1996 Leyden et al. ..... 340/568
5,565,848 A * 10/1996 Leyden et al. ..... 340/572
5,574,430 A 11/1996 Ott
5,861,807 A * 1/1999 Leyden et al. ..... 340/568
5,871,243 A * 2/1999 Wenk ..... 292/320
5,910,768 A 6/1999 Ott
5,911,762 A 6/1999 Ott

FOREIGN PATENT DOCUMENTS

| | | |
|---|---|---|
| DE | 195 15 660 | 7/1996 |
| DE | 298 12 378 | 5/1999 |
| DE | 198 03 491 | 8/1999 |
| WO | 96/31852 | 10/1996 |

* cited by examiner

*Primary Examiner*—Jeffery Hofsass
*Assistant Examiner*—Daniel Previl
(74) *Attorney, Agent, or Firm*—Barry R. Lipsitz; Douglas M. McAllister

(57) ABSTRACT

In order to develop an apparatus for safeguarding a merchandise item against theft, having a safeguarding part for fixing to the merchandise item and having a connecting cord for connecting the safeguarding part to an object which is not at risk of theft in such a way that it allows improved presentation of the merchandise item, it is proposed that the safeguarding part comprises a substantially rigid base part and also a fixing part, which can be fixed to the merchandise item and can be adapted to the form of the merchandise item at least in a partial region of its surface associated with the merchandise item.

31 Claims, 7 Drawing Sheets

APPARATUS FOR SAFEGUARDING A MERCHANDISE ITEM AGAINST THEFT

BACKGROUND OF THE INVENTION

The present invention relates to an apparatus for safeguarding a merchandise item against theft, having a safeguarding part for fixing to the merchandise item and having a connecting cord for connecting the safeguarding part to an object which is not at risk of theft.

Apparatuses of this type are known for example from DE 295 07 157 U1. They are used principally in stores for radio and television sets, video equipment, telephone systems, etc. In the stores, a great deal of display equipment is kept ready for operation and ready for test use for the customers. In order to avoid losses of equipment and, in particular, of the associated remote controls due to theft, safeguarding parts are usually fitted to the merchandise items which are at risk of theft, which safeguarding parts are in turn connected to an object which is not at risk of theft, for example to a display shelf or a display case. The merchandise item which is at risk of theft is thus safeguarded against theft by means of the connecting cord, test use of the safeguarded merchandise item by the customer nonetheless being made possible.

Apparatuses of this type have proved successful for safeguarding merchandise items with a planar surface. However, particularly comparatively small merchandise items, for example remote controls and mobile radio transceivers, usually have a curved surface, to which the safeguarding part can often be fixed only inadequately. Therefore, it has already been proposed (EP 0 663 656 A1), for the purpose of safeguarding the merchandise item, to use a monitoring sensor having a very flat, flexible housing made of a rubber-elastic material, with the result that the housing can be adapted to a domed or curved surface of the merchandise item and fixed by means of an adhesive layer. Although monitoring sensors of this type allow improved safeguarding of the merchandise item against theft, in many cases the presentation of the merchandise item is adversely affected.

SUMMARY OF THE INVENTION

It is an object of the present invention to develop an apparatus of the type in question for safeguarding a merchandise item against theft in such a way that it allows improved presentation of the merchandise item.

In the case of an apparatus of the type mentioned in the introduction, this object is achieved according to the invention by virtue of the fact that the safeguarding part comprises a substantially rigid base part and also a fixing part, which can be fixed to the merchandise item and can be adapted to the form of the merchandise item at least in a partial region of its surface associated with the merchandise item. A configuration of this type makes it possible, on the one hand, for the safeguarding part to be reliably fixed even to a merchandise item having a curved surface, in that the fixing part can be adapted to the form of the merchandise item at least in a partial region of its surface associated with the merchandise item. On the other hand, the merchandise item can be presented advantageously. To that end, the safeguarding part comprises a rigid base part which, by way of example, may serve as a support for the merchandise item to be presented.

In a preferred embodiment, it is provided that the fixing part is configured in a deformable manner at least in a partial region of its surface associated with the merchandise item. Thus, in this region, said fixing part may be produced from a plastically deformable material, for example. This enables the fixing part to be optimally adapted even to a complicated shape of the merchandise item to be safeguarded.

It is particularly favorable if that region of the fixing part which can firstly be adapted to the form of the merchandise item solidifies when applied to the merchandise item, that is to say subsequently retains the form that it has adopted in the first instance. The solidification of that region of the fixing part which can be adapted to the form of the merchandise item when fitted to the merchandise item has the advantage, in particular, that the solidified fixing part can be held in a particularly reliable manner on the merchandise item, for example by means of a flexible adhesive pad disposed on that surface of the fixing part which faces the merchandise item. As adhesive pad, there can be used, for example, a double-sided adhesive tape.

In a preferred embodiment of the apparatus according to the invention, it is provided that the fixing part comprises a deformable casing surrounding a flowable fixing agent which solidifies under pressure loading. The fixing part is thus formed in the manner of a pad, with a flowable fixing agent. If the safeguarding part is pressed onto the merchandise item, which may have a curved form, then the fixing part is adapted to the form of the merchandise item on account of the flowable fixing agent, the fixing agent solidifying, on account of the pressure loading acting on it, within a short time, for example within less than 30 seconds, preferably within from 10 to 20 seconds, and subsequently withstanding even high mechanical loads.

The fixing agent may advantageously have at least two fixing components which can be mixed together under pressure loading. In this case, it is particularly advantageous if the casing comprises at least two chambers, each for accommodating a fixing component, the chambers being separated from one another by a partition, which breaks open under pressure loading. If a pressure is exerted on the casing when the safeguarding part is fitted to the merchandise item, then the consequence of this is that the partition breaks open, with the result that the two fixing components are mixed together and the fixing part subsequently solidifies.

It is advantageous if the partition has preset breaking 10 points, since it can thereby be ensured, in a simple manner, that the partition breaks open when the safeguarding part is fitted to the merchandise item.

In an embodiment which can be produced in a particularly cost-effective manner, the fixing components comprise an adhesive and also a curing agent. This has the advantage that the period of time within which the fixing part solidifies when fitted to the merchandise item can be influenced in a simple manner by the choice of mixing ratio between adhesive and curing agent.

It is advantageous if the fixing part can be connected to the base part in a releasable manner. This affords the possibility of multiple recycling of the base part for monitoring different merchandise items, in that a fixing part that may have solidified is released from the base part and an unused fixing part is fitted.

In an alternative configuration of the apparatus according to the invention, it is provided that the fixing part comprises at least two contact elements which can be applied to the merchandise item, at least one contact element being held in a manner that allows it to pivot about at least one pivot axis. The pivotable mounting enables the contact elements to be oriented in an inclined manner with respect to one another, it being possible for the relative orientation of the contact elements to be adapted to the curvature of the surface of the merchandise item to be monitored. This ensures that the safeguarding part can be fixed reliably even to merchandise items having a curved surface, but moreover, the safeguarding part can have a configuration which is suitable for optimum presentation in each case. The use of safeguarding parts having at least two contact elements which are disposed at a spacing from one another, at least one of the contact elements being able to be pivoted, has proved successful in particular for reliably safeguarding mobile telephones, which mainly have a curved surface.

It is particularly favorable if at least two contact elements are each held in a manner that allows them to pivot, since this simplifies the fitting of the safeguarding part to merchandise items having a curved surface.

In this case, it is particularly favorable if the contact elements are held in a manner that allows them to pivot about pivot axes which are oriented parallel to one another. This makes it possible, in a simple manner, to adapt the orientation of the contact elements particularly to merchandise items having a cylindrical curved surface.

Particularly good adaptation to the shape of the merchandise item to be monitored can be ensured by at least one contact element being held in a manner that allows it to pivot about two pivot axes which are oriented perpendicularly to one another. In this case, it is particularly advantageous if two contact elements are held in a manner that allows them to pivot in each case about two pivot axes which are oriented perpendicularly to one another, with the result that at least two contact elements can be oriented in an inclined manner with respect to one another both in a first direction and in a second direction perpendicular thereto. Thus, by way of example, it may be provided that at least one contact element is held in a manner that allows it to pivot by means of a ball-and-socket joint.

In a particularly preferred embodiment, it is provided that the safeguarding part comprises at least three contact elements, at least two contact elements being held in a manner that allows them to pivot and the respective pivot axes being oriented perpendicularly to one another. Thus, by way of example, it may be provided that a first contact element has a rigid form, while a second and a third contact element are held in a manner that allows them to pivot, the pivot axis of the second contact element being oriented perpendicularly to the pivot axis of the third contact element. The use of at least three contact elements enables the safeguarding part to be fitted particularly securely to the merchandise item to be monitored, the pivotable mounting of two contact elements enabling simple adaptation even to a curved surface of the merchandise item.

It is particularly favorable if the safeguarding part comprises three contact elements, two contact elements being able to be pivoted about pivot axes which are oriented parallel to one another, and the third contact element being held in a manner that allows it to pivot transversely with respect to the pivot axes of the other two contact elements. This enables the safeguarding part to be fitted particularly reliably to a merchandise item which, in the manner of a tapering neck of a bottle, has a surface that is curved both in a first direction and in a second direction.

It is advantageous if the apparatus comprises a holding part for fixing to the object which is not at risk of theft, the holding part being connected to the safeguarding part via the connecting cord. The holding part preferably comprises an adhesive layer for fixing to the object. By means of the adhesive layer, the holding part can be fixed in a simple manner to the object, for example a display shelf or a table top, which is not at risk of theft, and by means of the connecting cord it is ensured that the safeguarding part is reliably connected to the holding part.

The presentation of the safeguarded merchandise item is simplified if the safeguarding part and the holding part comprise mutually complementary connecting means for establishing a releasable connection. In this case, it may be provided, in particular, that the safeguarding part can be connected to the holding part in a non-rotatable manner.

The connecting means associated with the safeguarding part are preferably disposed on the base part.

It is favorable if the holding part has a receptacle, into which the safeguarding part can be inserted. This makes it possible, in particular, to stabilize the safeguarding part laterally by the receptacle being formed in the shape of a basin, with the result that the safeguarding part can be deposited in a simple manner in the holding part and be removed from the holding part as required together with the merchandise item in order that the latter can be subjected to a test use.

Preferably, the safeguarding part can be suspended in the holding part. This enables the mechanical connection between safeguarding part and holding part to be established and released in a particularly simple manner. It is also conceivable that the safeguarding part can be plugged into the holding part.

In a particularly preferred embodiment, it is provided that the apparatus comprises at least one winding element for automatically winding up the connecting cord. This enables a particularly advantageous presentation of the safeguarded merchandise item, because, by means of the winding element, it is ensured that the connecting cord is wound up as far as possible and, consequently, does not hang loosely. If a customer picks up the merchandise item in order to subject it to a test use, then he can easily unwind the connecting cord counter to the effect of a restoring force, and if he puts the merchandise item back again, then the connecting cord is automatically wound up again.

In this case, it is advantageous if a winding element is disposed on the holding part, in particular integrated in a housing of the holding part or disposed in the housing of the holding part. In this way, it is ensured that the safeguarded merchandise item, having been subjected to a test use by the customer, is returned again to its original location, namely to the holding part associated with the safeguarding part, the connecting cord simultaneously being wound up. As an alternative or supplementary to this, it may be provided that a winding element is integrated into the base part.

In a particularly advantageous embodiment, it is provided that the apparatus according to the invention comprises a sensor element for monitoring proper contact with the merchandise item, it being possible for the sensor element to be connected to an electrical monitoring circuit, for outputting an alarm signal in the event of proper contact ceasing. In this case, the sensor element may be configured as a separate monitoring element which can be fitted to the merchandise item, for example, to a point on the merchandise item which is not very visible to the customer. Thus, it may preferably be provided that the connecting cord comprises an electrical conductor which is routed through the safeguarding part and is connected to the separate monitoring element. What may be involved in this case is, for example, a monitoring sensor of the kind described in the published European patent application EP 0 663 656 A1.

It is particularly advantageous if the sensor element for monitoring proper contact between the safeguarding part and the merchandise item is disposed on the safeguarding part. In this case, the safeguarding part with sensor element forms a monitoring sensor, the sensor element preferably being disposed on the safeguarding part in such a way that it cannot be recognized by the customer.

The merchandise item can be safeguarded against theft electronically by means of the sensor element. All that is necessary for this purpose is to connect the sensor element to a monitoring circuit disclosed in EP 0 116 701 B1, for example. If, during an attempted theft, the safeguarding part—or the monitoring element in the case of a sensor element configuration in the form of a separate monitoring element—is separated from the merchandise item, then this is detected by the sensor element, which thereupon provides an electrical measurement quantity which can be evaluated as an alarm situation by the monitoring circuit.

The sensor element is preferably disposed on the fixing part, for example on a contact element, so that it cannot be recognized by the customer.

In a particularly preferred embodiment, a sensor element is provided for monitoring the proper fixing of the holding part on the object which is at not at risk of theft, which sensor element can be connected to an electrical monitoring circuit for outputting an alarm signal in the event of proper contact between the holding part and the object which is not at risk of theft ceasing.

As explained above, a separate configuration in the form of a monitoring element coupled to the holding part can also be used in the case of the sensor element which monitors the proper contact between the holding part and the object which is not at risk of theft. It is particularly favorable if the sensor element which interacts with the object which is not at risk of theft is disposed on the holding part, preferably on a housing wall of the holding part.

The sensor element may comprise an electrical switching element and also a switching plunger which interacts with the merchandise item and/or with the object which is not at risk of theft. If the sensor element is removed from the merchandise item and/or the object, then the switching plunger actuates the switching element, with the result that a visual and/or acoustic alarm can be triggered, for example by means of a piezoelectric crystal.

It may be provided that the monitoring circuit is disposed in the base part. In this case, it is favorable if the base part additionally accommodates an electrical voltage supply unit, for example an electric battery, as voltage source for the monitoring circuit.

As an alternative, it may be provided that the monitoring circuit is disposed in the holding part, and that the connecting cord comprises an electrical conductor for establishing an electrical connection between the sensor element, which interacts with the merchandise item, and the monitoring circuit. In this case, the connecting cord serves both for mechanical and for electrical connection of the safeguarding part to the holding element. This makes it possible for not only the proper fitting of the safeguarding part to the merchandise item to be monitored electrically, but also the proper connection of the safeguarding part to the holding element. Specifically, if the connecting cord is separated during an attempted theft, in order to steal the merchandise item together with the fitted safeguarding part, then this can be detected by means of the monitoring circuit disposed in the holding element and an appropriate alarm signal can be output.

In a particularly preferred embodiment, it is provided that the monitoring circuit and also a winding element are disposed in the housing of the holding part, the monitoring circuit being electrically connected to the sensor element, which interacts with the merchandise item, via the connecting cord, which can be wound up by means of the winding element. In this case, the holding part not only performs the function of simplifying the fixing of the connecting cord to an object which is not at risk of theft, but it additionally accommodates both the electrical monitoring circuit and the winding element by means of which the connecting cord can be wound up as far as possible. The latter in this case not only forms a mechanical connection to the safeguarding part that can be fitted to the merchandise item, but simultaneously enables the electrical connection between the monitoring circuit and the sensor element which interacts with the merchandise item.

In this case, it is particularly advantageous if the holding part comprises a cord guide for guiding the connecting cord within the housing, since this enables the winding up of the connecting cord by means of the winding element to be simplified and frictional forces that occur to be reduced.

It is favorable if the cord guide is integrally connected to the housing of the holding part, because this enables a holding part configuration which can be produced in a particularly cost-effective manner.

Preferably, a visual and/or acoustic alarm transmitter, which is electrically connected to the monitoring circuit, is disposed in the housing of the holding part, with the result that a visual and/or acoustic alarm signal can be output via the alarm transmitter in the event of an attempted theft.

It is particularly advantageous if an electrical voltage supply unit, which is electrically connected to the monitoring circuit, is disposed in the housing of the holding part. This enables an autonomous configuration of the apparatus for safeguarding a merchandise item against theft, in which case not only additional connecting cables for connecting the apparatus to a central monitoring unit but also additional power supply connecting cables can be obviated. This makes it possible for a merchandise item which is at risk of theft to be presented optimally practically at any desired point within a store retail area and at the same time to be safeguarded against theft.

If a multiplicity of safeguarding parts are used in a store, and the proper fitting of said safeguarding parts to a merchandise item which is at risk of theft is intended to be monitored, then it is advantageous if the connecting cord comprises an electrical conductor for electrically connecting the sensor element to an external monitoring circuit. The latter may, for example, be disposed in a central unit, as is disclosed in EP 0 116 701 B1.

It is advantageous if the safeguarding part comprises an indicator element with the aid of which the proper fitting of the safeguarding part to the merchandise item and, preferably, also of the holding part to the object which is not at risk of theft and/or an alarm signal can be indicated. Thus, by way of example, a light-emitting diode whose luminous signal changes in the event of an attempted theft may be disposed on the safeguarding part.

BRIEF DESCRIPTION OF THE DRAWINGS

The following description of preferred embodiments of the invention serves, in connection with the drawing, to provide further elucidation.

DETAILED DESCRIPTION OF THE INVENTION

Figure 1:
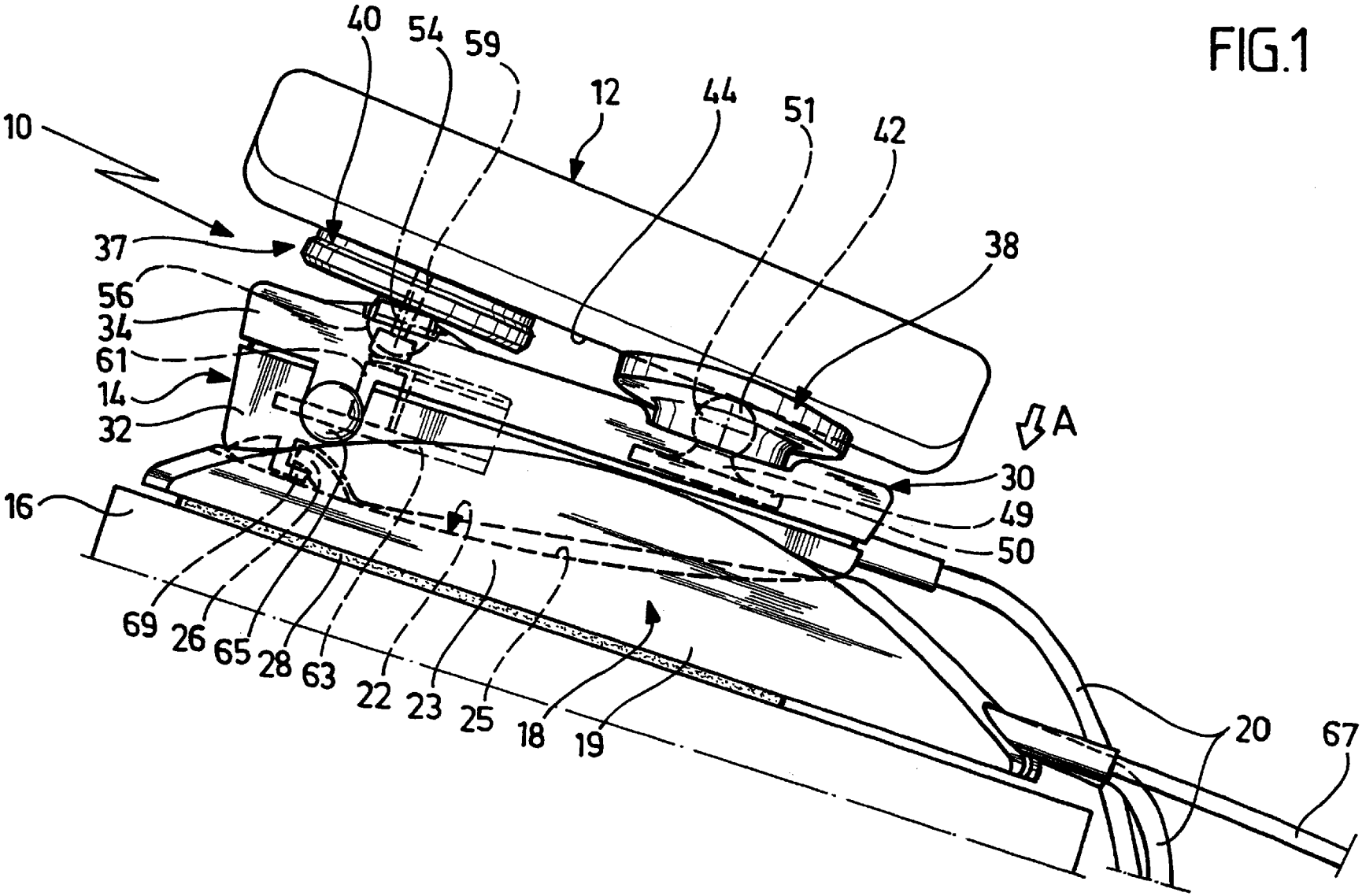
FIG. 1 shows a diagrammatic side view of a first embodiment of an apparatus for safeguarding a merchandise item against theft.

A first embodiment—which in its entirety is allocated the reference symbol 10—of an apparatus for safeguarding a merchandise item against theft is shown in diagrammatic illustration in FIGS. 1 to 5. It comprises a safeguarding part 14, which can be fitted to a merchandise item 12 which is at risk of theft, and a holding part 18 with a housing 19, which holding part can be fixed on an object which is not at risk of theft, for example a lid 16 of a display case, said lid being oriented in an inclined manner with respect to the horizontal for presentation purposes, the safeguarding part 14 being connected to the holding part 18 in an unreleasable manner via a connecting cord 20. The merchandise item 12 is shown only comparatively small in the drawing, in order to obtain a better overview. As already mentioned in the introduction, the merchandise item 12 that may be protected against theft may be, in particular, a mobile radio transceiver or a remote control.

Figure 2:
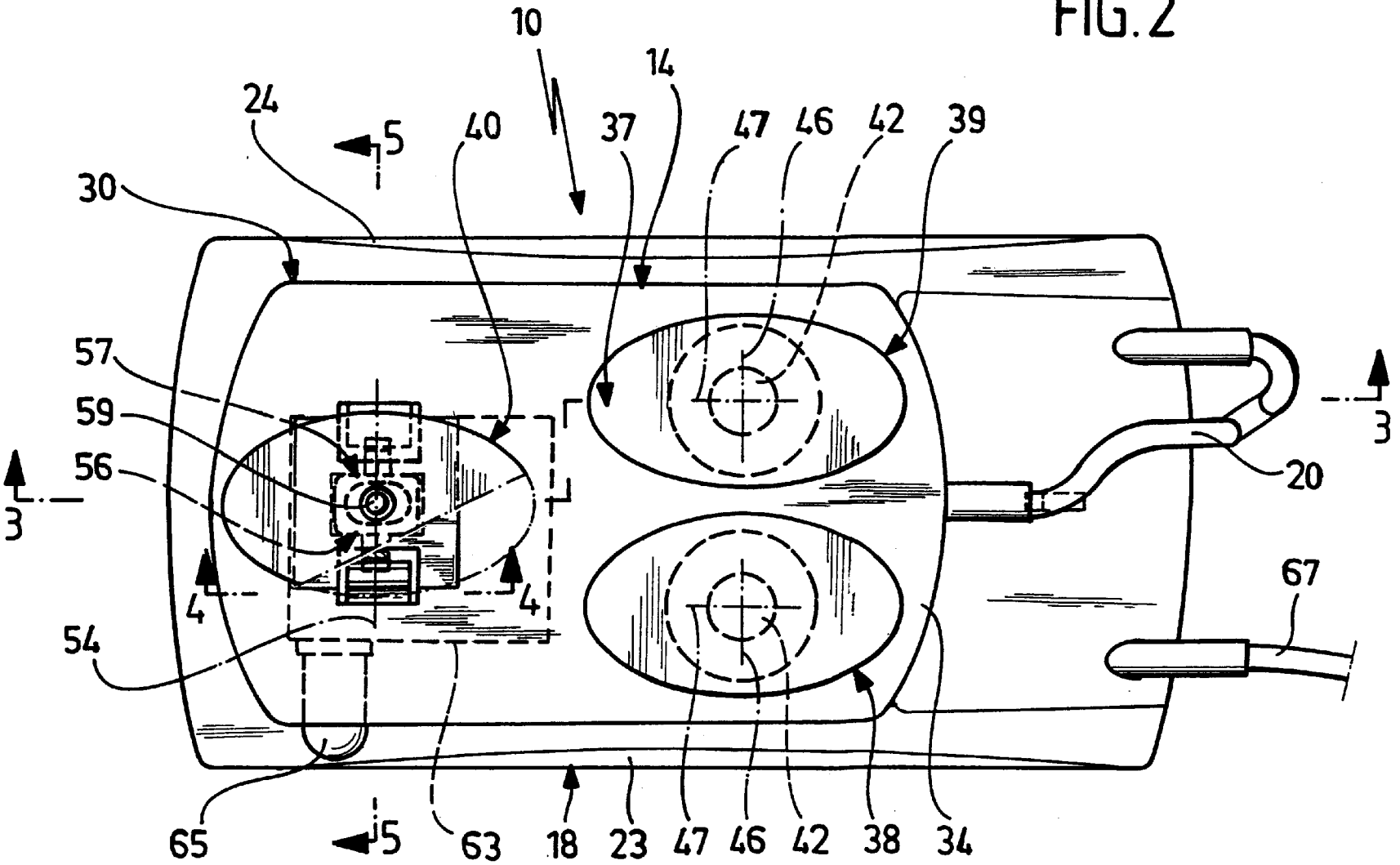
FIG. 2 shows a plan view of the apparatus in the direction of the arrow A from FIG. 1.
Figure 3:
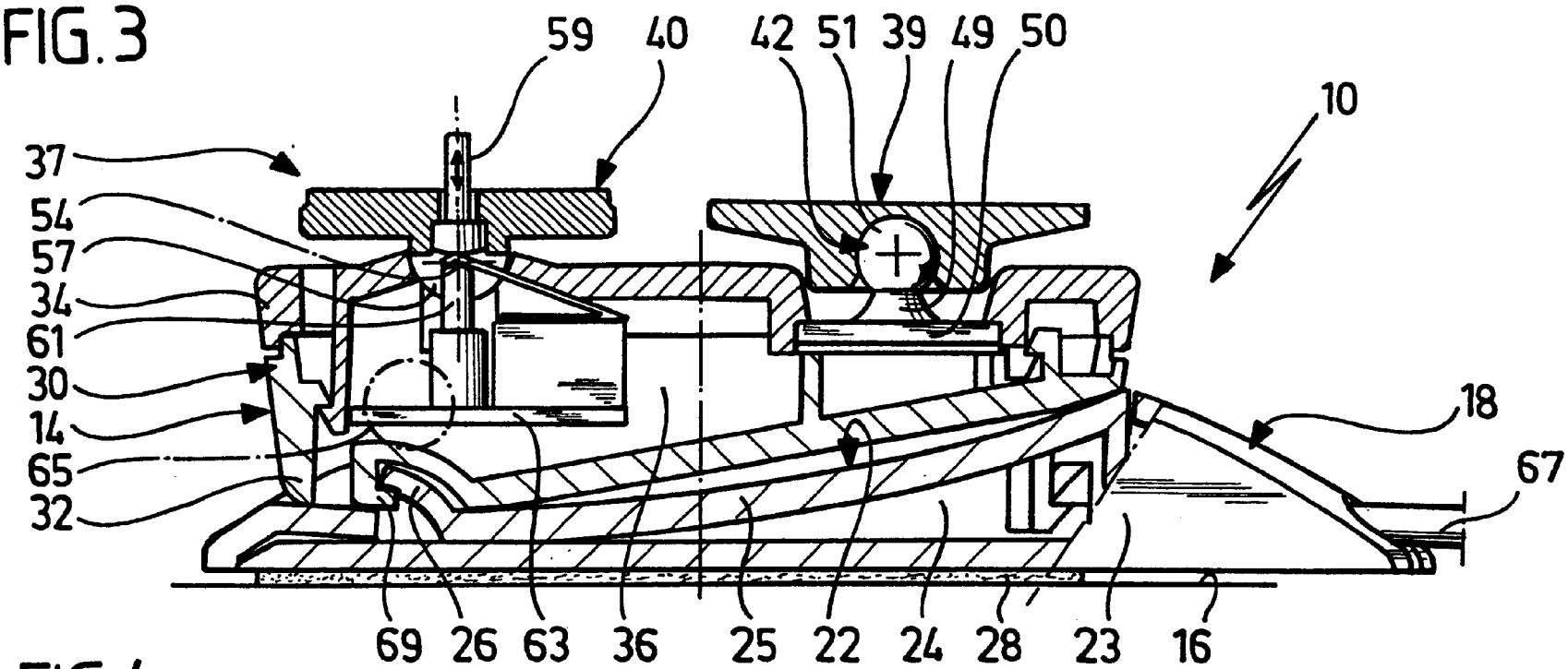
FIG. 3 shows a sectional view along the line 3—3 in FIG. 2.
Figure 4:
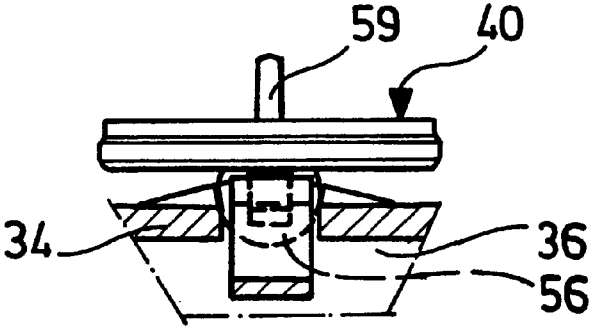
FIG. 4 shows a sectional view along the line 4—4 in FIG. 2
Figure 5:
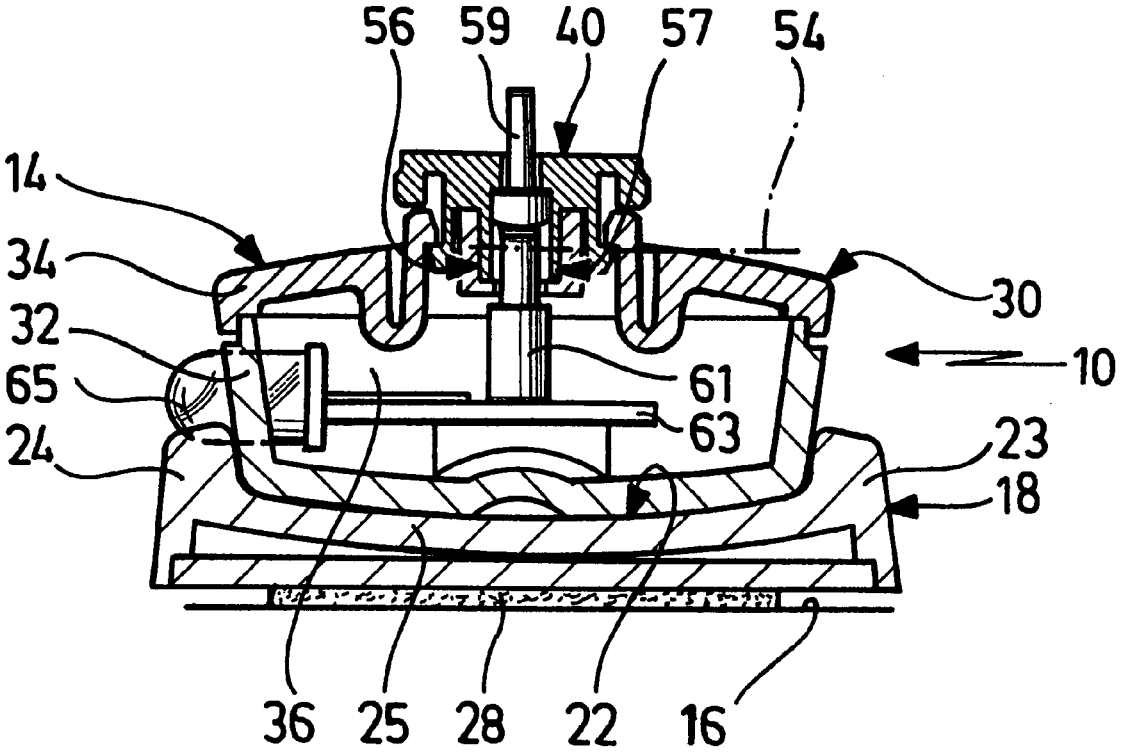
FIG. 5 shows a sectional view along the line 5—5 in FIG. 2.

As becomes clear from FIGS. 2 and 5, in particular, the holding part 18 has, on its top side remote from the lid 16 of the display case, an approximately basin-shaped receptacle 22 having side walls 23, 24, oriented substantially parallel to one another, and a bottom wall 25, from which a latching hook 26, which becomes clear from FIG. 3, in particular, projects upward.

On its underside facing the lid 16 of the display case, the holding part 18 bears an adhesive pad 28 in the form of a double-sided adhesive tape, with the aid of which the holding part 18 can be fixed to the lid 16 of the display case.

The safeguarding part 14 comprises a bipartite rigid base part 30 having a lower part 32, which can be inserted into the receptacle 22 of the holding part 18 and whose form substantially corresponds to the profile of the receptacle 22, and having an upper part 34 covering the lower part 32. The lower part 32 and upper part 34 can be latched together to form a cavity 36 via latching means which are known per se and are therefore illustrated only diagrammatically in the drawing.

On its top side remote from the holding part 18, the base part 30 carries a fixing part 37—which can be adapted to the merchandise item—with three contact elements 38, 39, 40, which are spaced apart from one another and with the aid of which the safeguarding part 14 can be applied to the merchandise item 12 to be monitored. In the longitudinal direction of the safeguarding part 14 at the same level next to one another, two contact elements 38 and 39 are held in a manner that allows them to pivot on the upper part 34 in each case by means of a ball-and-socket joint 42 and can be oriented in an inclined manner with respect to one another, in order to be able to be adapted to the profile of a curved surface 44 of the merchandise item 12. The two contact elements. 38, 39 articulated to the upper part 34 are, in particular, each held in a manner that allows them to pivot about two pivot axes 46, 47 which are oriented perpendicularly to one another, said axes being illustrated by dash-dotted lines in FIG. 2. In this case, the mounting is effected in each case by means of a bearing journal 49, which is integrally connected to a bearing plate 50 clamped in between the lower part 32 and the upper part 34 and whose upwardly projecting free end 51 has a spherical form. The contact elements 38 and 39 are formed substantially in the shape of plates and engage around the free end 51 of the bearing journal 49, with the result that they can be oriented in any desired direction in an inclined manner with respect to the longitudinal axis of the bearing journal 49.

In contrast to this, the third contact element 40 is held on the upper part 34 in a manner that allows it to pivot only about a pivot axis 54 which is oriented transversely with respect to the longitudinal axis of the safeguarding part 14. For this purpose, it has two pivot journals 56, 57 on its underside facing the upper part 34, said pivot journals being oriented coaxially with respect to the pivot axis 54 and being held in corresponding guides which are integrally connected to the upper part 34. On its top side remote from the upper part 34, the contact element 40 is formed in the shape of a plate in a manner corresponding to the contact elements 38 and 39. The contact element 40 is arranged centrally, i.e. level between the contact elements 38 and 39, transversely with respect to the longitudinal direction of the safeguarding part 14.

All three contact elements 38, 39, 40 can be fixed in a simple manner to the merchandise item 12 by means of adhesive pads (not illustrated in the drawing) which correspond to the adhesive pad 28 of the holding part 18 and may likewise be formed as a double-sided adhesive tape.

In order to subject the merchandise item 12 to a test use, said merchandise item may be removed together with the safeguarding part 14 from the receptacle 22 of the holding part 18, the connecting cord 20 ensuring that the merchandise item 12 is safeguarded against theft.

The proper fitting of the safeguarding part 14 to the merchandise item 12 is monitored by means of an electrical sensor element 58 (see FIG. 3). The latter comprises a switching plunger 59, which is spring-loaded in the direction of the merchandise item 12, engages through a central hole in the contact element 40 and is coupled to an electrical switching element 61 disposed within the cavity 36—formed by the lower part 32 and the upper part 34—of the base part 30 on an electrical printed circuit board 63. In the case of the first embodiment illustrated, said printed circuit board accommodates an electrical monitoring circuit which is known per se, and, therefore, is not illustrated in the drawing, and which provides an alarm signal when the switching plunger 59 is actuated, with the result that detachment of the contact element 40 from the merchandise item 12 to be monitored leads to the triggering of a visual and/or acoustic alarm signal. To that end, the monitoring circuit disposed on the printed circuit board 63 may have a piezoelectric crystal, for example. In addition, a light-emitting diode 65 is disposed on the safeguarding part 14, said diode being electrically connected to the printed circuit board 63, with the result that a visual alarm signal can be output.

electronic monitoring arrangement can be indicated by means of the light-emitting diode 65.

The voltage supply for the monitoring circuit disposed on the printed circuit board 63 is provided by means of a connecting cable 67, which can be connected to a central monitoring unit and is connected to the holding part 18, from which the electrical connection leads to the printed circuit board 63 via the connecting cord 20, which comprises a corresponding electrical conductor for this purpose. The connection of the safeguarding part 14 via the connecting cord 20 and the connecting cable 67 to a central monitoring unit also affords the possibility of disposing the monitoring circuit in the external monitoring unit instead of on the printed circuit board 63. As an alternative, provision may also be made for positioning an electric battery in the cavity 36 of the base part 30 or within the holding part 18, which means that a connection to an external monitoring unit becomes unnecessary and the connecting cable 67 can be omitted. If the electric battery is disposed within the base part 30, the connecting cord 20 serves only for mechanically connecting the safeguarding part 14 to the holding part 18, but if the battery is disposed in the holding part 18, then the connecting cord 20 additional performs the function of an electrical connection of the battery to the monitoring circuit disposed within the base part 30.

From the above., it becomes clear that the safeguarding part 14 can be reliably fitted by means of the fixing part 37 even to a curved surface of the merchandise item 12 to be monitored. At the same time, the merchandise item 12 can be presented in an advantageous manner by the insertion of the base part 30 into the receptacle 22 of the holding part 18, the side walls 23 and 24 of the receptacle 22 ensuring a non-rotatable mounting of the merchandise item 12, and at the same time, by means of a latching clip 69, which is disposed on the underside—facing the bottom wall 25 of the receptacle 22—of the base part 30 and engages behind the latching hook 26, the safeguarding part 14 being able to be suspended in the holding part 18 in a simple manner. This makes it possible to present the merchandise item 12 with a curved surface 44 advantageously on an emplacement area oriented in an inclined manner with respect to the horizontal, as is formed for example by the lid 16 of the display case.

Figure 6:
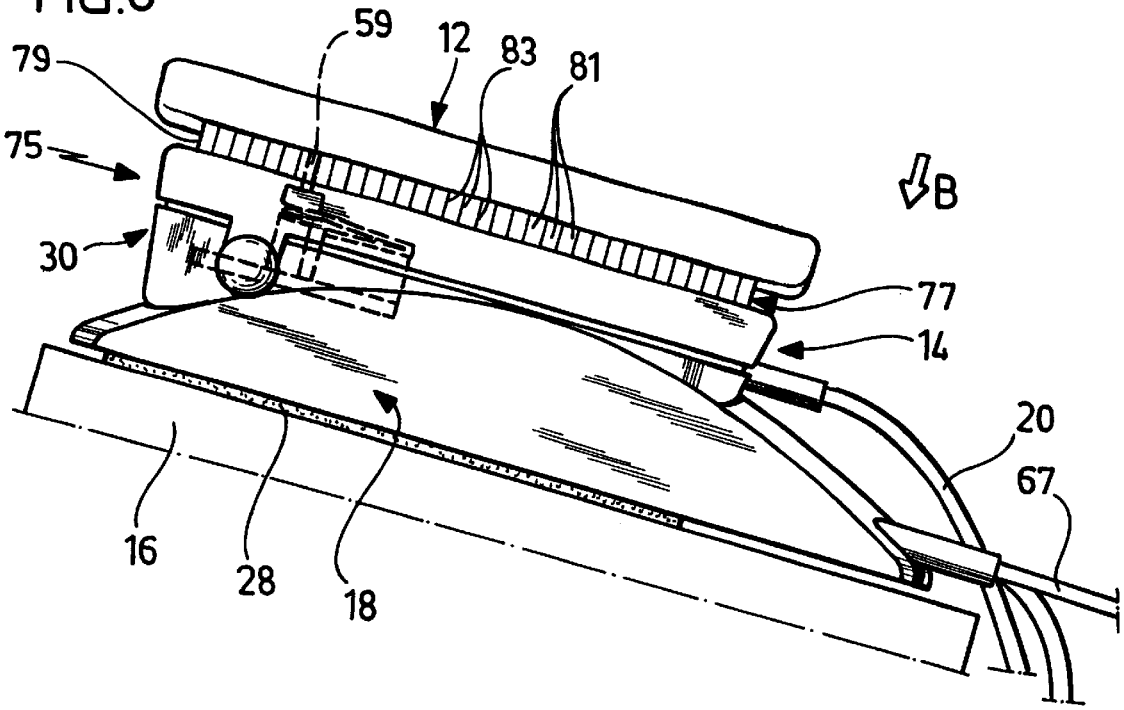
FIG. 6 shows a diagrammatic side view of a second embodiment of an apparatus for safeguarding a merchandise item against theft.
Figure 7:
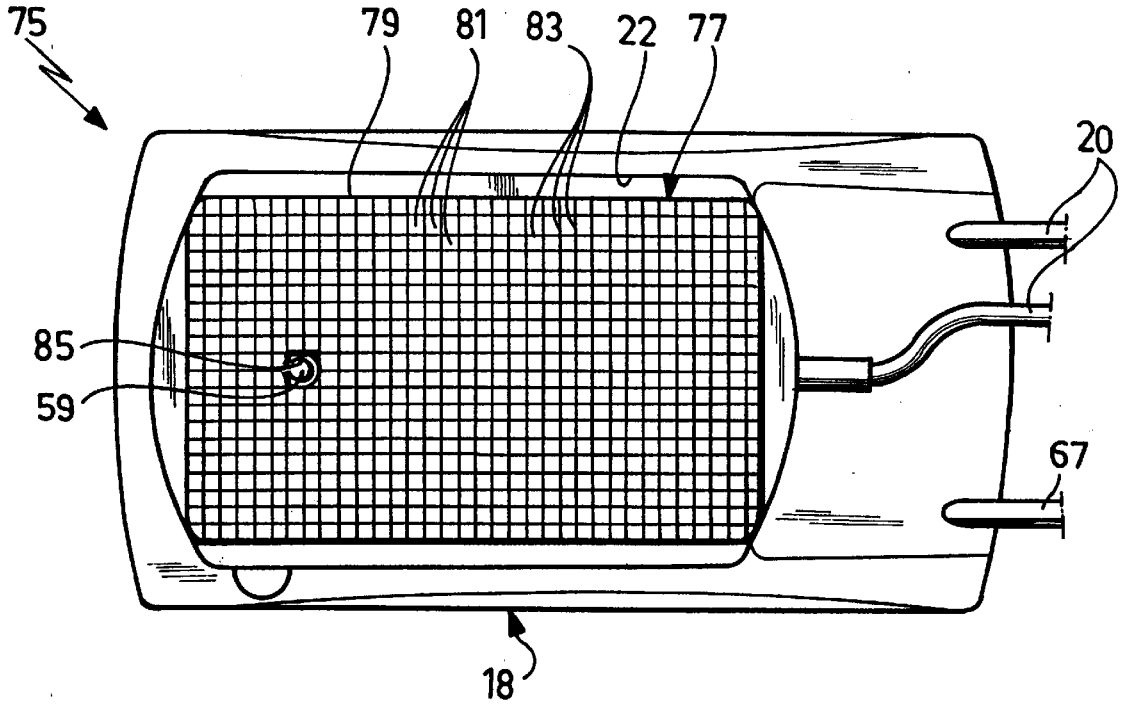
FIG. 7 shows a plan view of the apparatus in the direction of the arrow B from FIG. 6.
Figure 8:
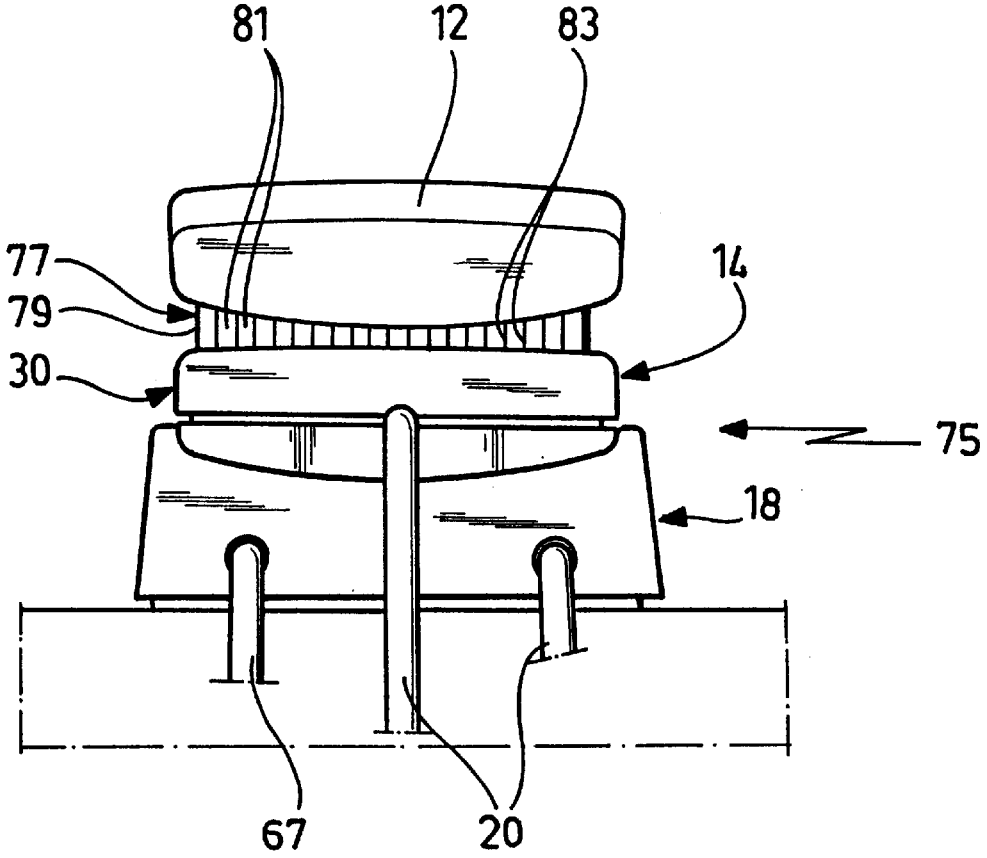
FIG. 8 shows a front view of the apparatus as shown in FIG. 6.

In FIGS. 6, 7 and 8, there is shown in diagrammatic illustration a second embodiment of an apparatus for safeguarding a merchandise item against theft, which, in its entirety, is allocated the reference symbol 75. It differs from the apparatus 10 described above with reference to FIGS. 1 to 5 merely by virtue of its alternative configuration of the fixing part. Instead of three contact elements, the apparatus 75 makes use of a fixing part 77 in the form of a fixing pad which can be applied in a surface-adhering manner to the merchandise item 12 to be monitored, and it is adapted to the form of the merchandise item 12. Otherwise, the configuration of the apparatus 75 corresponds to the configuration of the apparatus 10, so that reference may be made to the corresponding description of the apparatus 10 in order to avoid repetition. Therefore, the same reference symbols as in the first embodiment described above are used for identical structural parts. The apparatus 75 likewise has a holding part 18 which is connected to a safeguarding part 14 via a connecting cord 20 and can be fixed on a support 16 by means of an adhesive pad 28. A base part 30 which can be inserted into a receptacle 22 of the holding part 14 is once again used for the safeguarding part 14. The base part 30 accommodates a printed circuit board 63, which bears a monitoring circuit (not illustrated in the drawing) which, on the one hand, is electrically connected to the switching element 61 for the purpose of monitoring proper contact of the fixing part 77 on the merchandise item 12 to be monitored and, on the other hand, is connected via the connecting cable 67 to a central monitoring unit (not illustrated in the drawing).

The safeguarding part 14 is fixed to the merchandise item 12 to be monitored by means of the fixing part 77. The latter is configured in the manner of a pad and has a flexible casing 79, which defines a multiplicity of chambers 81 which are each separated from one another by means of a partition 83. The individual chambers 81 each accommodate a fixing component of a two-component, flowable fixing agent, to be precise one fixing component is formed by an adhesive and the other fixing component by a curing agent. The partitions 83 each have a preset breaking point (not illustrated in the drawing).

If the safeguarding part 14 with the pad-like fixing part 77 is pressed against the merchandise item 12 to be monitored, the flexible casing 79 with the flowable fixing agent deforms and that surface of the fixing part 77 which faces the merchandise item 12 is adapted to the form of the merchandise item 12. At the same time, the partitions 83 break open at their preset breaking points on account of the pressure load that occurs, with the result that the two components of the fixing agent can mix together, i.e. the adhesive comes into contact with the curing agent. The mixing together of the two mixing components when the safeguarding part 14 is pressed onto the merchandise item 12 to be monitored thus has the consequence that the fixing part 77 adopts a rigid configuration optimally adapted to the form of the merchandise item 12.

In a corresponding manner to that explained with reference to FIGS. 1 to 5, a switching element 61 is also provided in the second embodiment—illustrated in FIGS. 6 to 8—for the purpose of properly monitoring the fixing of the safeguarding part.14 to the merchandise item 12 to be monitored, the switching plunger 59 of which switching element engages through a passage opening 85 in the casing 79 and can thus be applied to the merchandise item 12. If the fixing part 77 is separated from the merchandise item 12 during an attempted theft, then the switching plunger 59 is activated in this case, which leads to the triggering of an alarm—as is described above.

Figure 10:
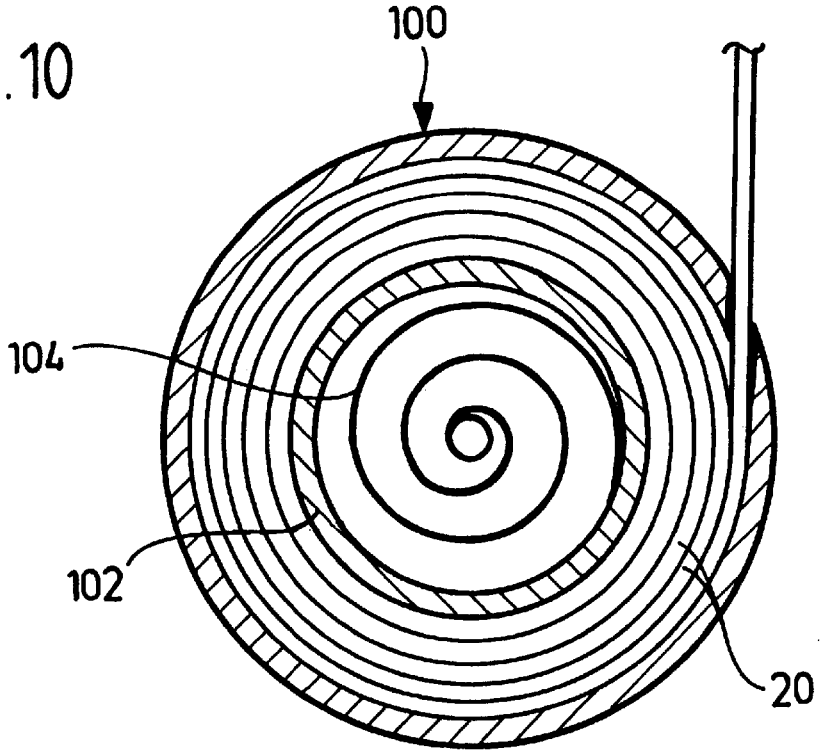
FIG. 10 shows a sectional view along the line A—A in FIG. 9.
Figure 9:
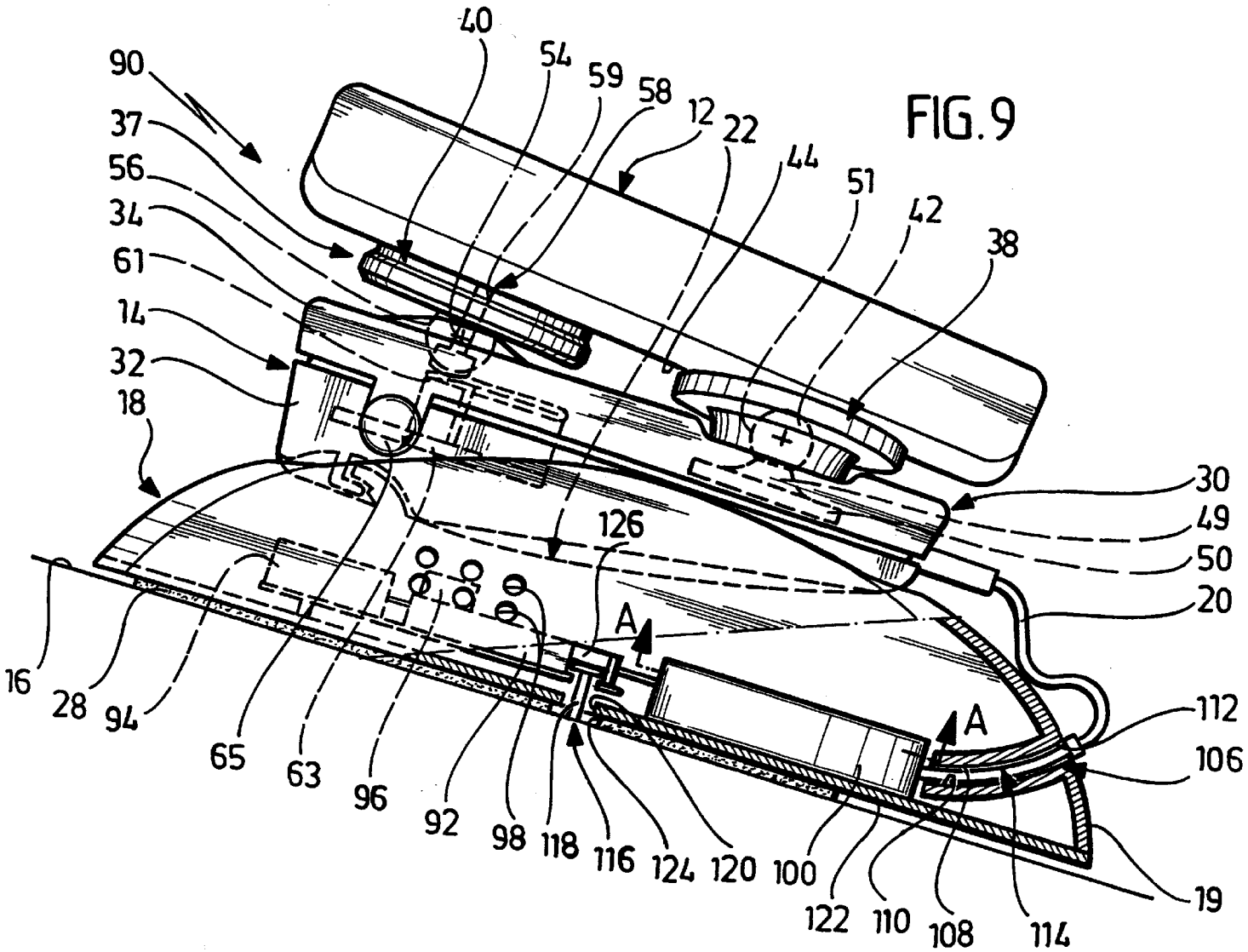
FIG. 9 shows a diagrammatic side view of a third embodiment of an apparatus for safeguarding a merchandise item against theft.

In FIGS. 9 and 10, there is shown in diagrammatic illustration a third embodiment of an apparatus for safeguarding a merchandise item against theft. In its 35 entirety, it is allocated the reference symbol 90. It differs from the first embodiment described above with reference to FIGS. 1 to 5 by the use of a winding element 100—explained below—for automatically winding up the connecting cord 20, by the disposition of the monitoring circuit—coupled to the switching element 61—within the holding part 18, and by the use of an additional sensor element 116 for monitoring the proper fixing of the holding part 18 to the object which is not at risk of theft, said object being in the form of the lid 16. For the rest, said third embodiment is formed in a corresponding manner to the first embodiment illustrated in FIGS. 1 to 5. Therefore, the same reference symbols as in the first embodiment described above are used for identical structural parts, and, in this regard, reference is made to the corresponding description of the apparatus 10 in order to avoid repetition.

In contrast to the first embodiment, in the case of the apparatus 90 illustrated in FIGS. 9 and 10, an electrical monitoring circuit 92 is not disposed on the printed circuit board 63 bearing the switching element 61, but rather within the housing 19 of the holding part 18. For voltage supply purposes, the monitoring circuit 92 is electrically connected to a voltage supply unit in the form of a battery 94 likewise disposed within the housing 19, and, for the outputting of an alarm signal, the housing 19 additionally accommodates an acoustic alarm transmitter in the form of a piezoelectric crystal 96, which is likewise connected to the monitoring circuit 92. For the emergence of the sound waves generated by the piezoelectric crystal 96 in the event of an attempted theft, sound exit openings 98 are provided in the housing 19 of the holding part 18, thereby ensuring that a clearly perceptible acoustic signal sounds during an attempted theft. In addition, a visual alarm signal is also output by means of the light-emitting diode 65 disposed on the safeguarding part 14.

The monitoring circuit 92 is electrically connected to the switching element 61 via the connecting cord 20. In order to automatically wind up the connecting cord 20, a winding element 100 is disposed within the housing 19 of the holding part 18 and winds up the connecting cord 20 as far as possible. To that end, the winding element 100—as becomes clear from FIG. 10, in particular—comprises a coil 102, which is mounted in a rotatable manner and accommodates a spiral spring 104 and onto which the connecting cord 20 can be wound up. The connecting cord 20 can be unwound counter to the effect of the spiral spring 104 if a customer, for example for the purpose of subjecting the merchandise item 12 to be monitored to a test use, removes the merchandise item 12 with the safeguarding part 14 fitted thereto from the holding part 18. If the customer then puts the merchandise item 12 back again, the winding element 100 ensures that the connecting cord 20 is wound up on account of the spring force of the spiral spring 104 on the coil 102.

In order to ensure optimum guidance of the connecting cord 20 to the winding element 100 within the housing 19 of the holding part 18, there is provided within the housing 19 a cord guide 106, with two guide surfaces 108, 110, which are arranged at a spacing from one another and are each arcuately curved and between which the connecting cord 20 is led through proceeding from the winding element 100, the two guide surfaces 108, 110 defining a guide duct 114 which opens into an outlet opening 112 in the housing 19.

The holding part 18 of the apparatus 90 is fixed to the lid 16 by means of the adhesive pad 28, for example by means of a double-sided adhesive tape. In order to ensure that the apparatus 90 cannot be removed unnoticed together with the merchandise item 12 from the lid 16, the apparatus 90 comprises, in addition to the switching plunger 59—engaging against the merchandise item 12—and the corresponding switching element 61, a further sensor unit 116 for monitoring the proper fitting of the holding part 18 to the object 16 which is not at risk of theft. This sensor element 116 comprises a switching plunger 118, which engages through a central through hole 120 in the bottom wall 122 in the housing 19 of the holding part 18 and also through a corresponding cutout 124 in the adhesive pad 28 and engages against the lid 16. The switching plunger 118 is electrically connected to a switching element—disposed in the housing 19—in the form of a microswitch 126, which in turn is connected to the monitoring circuit 92. If the holding part 18 is removed from the lid 16 in an unauthorized manner, then the switching plunger 118, which is spring-loaded in the direction of the lid 16, actuates the microswitch 126. This last is detected as an alarm situation by the monitoring circuit 92, and a visual and acoustic alarm is thereupon output by means of the piezoelectric crystal 96 and the light-emitting diode 65 in the same way as in the event of unauthorized removal of the merchandise item 12 from the safeguarding part 14.

The apparatus 90 enables a merchandise item 12 which is at risk of theft to be presented in a manner which is particularly conducive to a sale. Said merchandise item is safeguarded against theft both mechanically and electronically. The safeguarding part 14 which can be adapted to the form of the merchandise item 12 and the disposition of said safeguarding part on the holding part 18 enable the merchandise item 12 which is safeguarded against theft to be presented in an optimum manner.

What is claimed is:

1. Apparatus for safeguarding a merchandise item against theft, comprising:

a safeguarding part for fixing to the merchandise item, said safeguarding part having a substantially rigid base part and a fixing part;

said fixing part having at least two contact elements which can be applied to the merchandise item, at least one contact element being held in a manner that allows it to pivot about at least one pivot axis so that the fixing part can be at least partially adapted to the form of the merchandise item; and a connecting cord for connecting the safeguarding part to an object which is not at risk of theft.

2. Apparatus according to claim 1, wherein at least two contact elements are held in a manner that allows them to pivot.

3. Apparatus according to claim 2, wherein the contact elements are held in a manner that allows them to pivot about pivot axes which are oriented parallel to one another.

4. Apparatus according to claim 1, wherein at least one contact element is held in a manner that allows it to pivot about two pivot axes which are oriented perpendicularly to one another.

5. Apparatus according to claim 1, wherein at least two contact elements are held in a manner that allows them to pivot in each case about two pivot axes which are oriented perpendicularly to one another.

6. Apparatus according to claim 1, wherein at least one contact element is held in a manner that allows it to pivot by means of a ball-and-socket joint.

7. Apparatus according to claim 1, wherein the fixing part comprises at least three contact elements, at least two contact elements being held in a manner that allows them to pivot with pivot axes which are oriented perpendicularly to one another.

8. Apparatus according to claim 1, wherein the fixing part comprises three contact elements, two contact elements being able to be pivoted about pivot axes which are oriented parallel to one another, and the third contact element being held in a manner that allows it to pivot transversely with respect to the pivot axes of the other two contact elements.

9. Apparatus according to claim 1, wherein the apparatus comprises a holding part for fixing to the object which is not at risk of theft, the holding part being connected to the safeguarding part via the connecting cord.

10. Apparatus according to claim 9, wherein the safeguarding part and the holding part comprise mutually complementary connecting means for establishing a releasable connection.

11. Apparatus according to claim 9, wherein the holding part has a receptacle, into which the safeguarding part can be inserted.

12. Apparatus according to claim 9, wherein the safeguarding part can be suspended in the holding part.

13. Apparatus according to claim 9, wherein the apparatus comprises a sensor element for monitoring proper contact between the holding part and the object which is not at risk of theft, it being possible for the sensor element to be connected to an electrical monitoring circuit, for outputting an alarm signal in the event of proper contact between the holding part and the object which is not at risk of theft ceasing.

14. Apparatus according to claim 13, wherein the sensor element which interacts with the object which is not at risk of theft is disposed on the holding part.

15. Apparatus according to claim 14, wherein the sensor element which interacts with the object which is not at risk of theft is disposed on a housing wall of the holding part.

16. Apparatus according to claim 1, wherein the apparatus comprises at least one winding element for automatically winding up the connecting cord.

17. Apparatus according to claim 16, wherein a winding element is disposed on the holding part.

18. Apparatus according to claim 17, wherein the winding element is disposed in a housing of the holding part.

19. Apparatus according to claim 16, wherein a winding element is integrated into the base part.

20. Apparatus according to claim 1, wherein the apparatus comprises a sensor element for monitoring proper contact between the apparatus and the merchandise item, it being possible for the sensor element to be connected to an electrical monitoring circuit, for outputting an alarm signal in the event of proper contact between the apparatus and the merchandise item ceasing.

21. Apparatus according to claim 20, wherein the sensor element is disposed on the safeguarding part.

22. Apparatus according to claim 21, wherein the sensor element is disposed on the fixing part.

23. Apparatus according to claim 20, wherein the connecting cord comprises an electrical conductor for electrically connecting the sensor element to an external monitoring circuit.

24. Apparatus according to claim 20, wherein the sensor element comprises an electrical switching element, with a switching plunger which interacts with the merchandise item.

25. Apparatus according to claim 20, wherein the monitoring circuit is disposed in the base part.

26. Apparatus according to claim 20, wherein the monitoring circuit is disposed in the holding part, and in that the connecting cord comprises an electrical conductor for establishing an electrical connection between the sensor element, which interacts with the merchandise item, and the monitoring circuit.

27. Apparatus according to claim 26, wherein the monitoring circuit and a winding element are disposed in the housing of the holding part, the monitoring circuit being electrically connected to the sensor element, which interacts with the merchandise item, via the connecting cord, which can be wound up by means of the winding element.

28. Apparatus according to claim 27, wherein the holding part comprises a cord guide for guiding the connecting cord within the housing of the holding part.

29. Apparatus according to claim 28, wherein the cord guide is integrally connected to the housing of the holding part.

30. Apparatus according to claim 26, wherein at least one of a visual alarm transmitter and an acoustic alarm transmitter is electrically connected to the monitoring circuit and is disposed in the housing of the holding part.

31. Apparatus according to claim 26, wherein an electrical voltage supply unit, which is electrically connected to the monitoring circuit, is disposed in the housing of the holding part.

* * * * *